US008123568B2

(12) United States Patent
Meyer et al.

(10) Patent No.: US 8,123,568 B2
(45) Date of Patent: Feb. 28, 2012

(54) BIOMEDICAL ELECTRODE CONNECTORS

(75) Inventors: Peter Meyer, Shrewsbury, MA (US); Kathleen Tremblay, Westfield, MA (US); Joseph R. Shoum, Ware, MA (US); Frank Cable, Chicopee, MA (US); Mark Tauer, Belchertown, MA (US); David Selvitelli, Suffield, MA (US); Warren Copp, Chicopee, MA (US)

(73) Assignee: Tyco Healthcare Group LP, Mansfield, MA (US)

( * ) Notice: Subject to any disclaimer, the term of this patent is extended or adjusted under 35 U.S.C. 154(b) by 0 days.

(21) Appl. No.: 13/014,368

(22) Filed: Jan. 26, 2011

(65) Prior Publication Data

US 2011/0117793 A1 May 19, 2011

Related U.S. Application Data

(62) Division of application No. 12/332,565, filed on Dec. 11, 2008, now Pat. No. 7,892,017.

(60) Provisional application No. 61/012,817, filed on Dec. 11, 2007.

(51) Int. Cl.
*H01R 24/04* (2006.01)

(52) U.S. Cl. ..... 439/668; 439/909; 607/37; 607/117

(58) Field of Classification Search ..... 439/725–729, 439/909, 668; 128/2.1 E; 607/37, 119
See application file for complete search history.

(56) References Cited

U.S. PATENT DOCUMENTS

| | | | | |
|---|---|---|---|---|
| 3,210,719 | A | 10/1965 | Graeff | |
| 3,606,881 | A | 9/1971 | Woodson | |
| 3,728,669 | A | 4/1973 | Churla | |
| 3,805,769 | A | 4/1974 | Sessions | |
| 3,895,635 | A | 7/1975 | Justus et al. | |
| 3,964,470 | A * | 6/1976 | Trombley | 600/377 |
| 4,026,278 | A | 5/1977 | Ricketts et al. | |
| 4,056,299 | A | 11/1977 | Paige | |
| 4,112,941 | A * | 9/1978 | Larimore | 600/394 |
| 4,161,174 | A * | 7/1979 | Mercuri | 600/394 |
| 4,165,141 | A | 8/1979 | Williams et al. | |
| 4,166,465 | A | 9/1979 | Esty et al. | |
| 4,253,721 | A | 3/1981 | Kaufman | |
| 4,304,453 | A | 12/1981 | Grunwald | |
| 4,540,236 | A | 9/1985 | Peers-Trevarton | |
| 4,632,121 | A | 12/1986 | Johnson et al. | |
| 4,674,817 | A * | 6/1987 | Olms | 439/592 |
| 4,685,467 | A | 8/1987 | Cartmell et al. | |
| 4,824,395 | A | 4/1989 | Blaha | |
| 4,842,557 | A | 6/1989 | Muz | |
| 5,199,432 | A * | 4/1993 | Quedens et al. | 600/376 |
| 5,232,383 | A * | 8/1993 | Barnick | 439/859 |
| 5,326,272 | A | 7/1994 | Harhen et al. | |
| 5,390,883 | A | 2/1995 | Songhurst | |
| 5,546,950 | A | 8/1996 | Schoeckert et al. | |
| 5,897,406 | A * | 4/1999 | Benes et al. | 439/859 |
| 5,944,562 | A | 8/1999 | Christensson | |

(Continued)

FOREIGN PATENT DOCUMENTS

EP 0 247 560 11/2008

*Primary Examiner* — Truc Nguyen
(74) *Attorney, Agent, or Firm* — Lisa E. Winsor, Esq.

(57) ABSTRACT

A biomedical electrode connector for coupling with a biomedical electrode of the type including an electrode base and a male terminal projecting from the electrode base is provided.

28 Claims, 14 Drawing Sheets

U.S. PATENT DOCUMENTS

| | | | | |
|---|---|---|---|---|
| 6,023,631 | A | 2/2000 | Carmell et al. | |
| 6,276,955 | B1 | 8/2001 | Hollesen et al. | |
| 6,487,430 | B1 | 11/2002 | Henderson et al. | |
| 6,638,120 | B2 | 10/2003 | Costa | |
| 6,716,070 | B2 | 4/2004 | Christensson | |
| 6,716,071 | B2 | 4/2004 | Miyazaki | |
| 6,800,001 | B1 * | 10/2004 | Costa | 439/888 |
| 7,445,522 | B2 | 11/2008 | Burnes et al. | |
| 7,618,279 | B1 | 11/2009 | Osborn et al. | |
| 7,819,710 | B2 * | 10/2010 | McIntire et al. | 439/890 |

* cited by examiner

BIOMEDICAL ELECTRODE CONNECTORS

CROSS-REFERENCE TO RELATED APPLICATIONS

This application is a divisional of pending U.S. application Ser. No. 12/332,565 filed Dec. 11, 2008, which claims priority to and the benefit of U.S. Provisional Application Ser. No. 61/012,817 filed Dec. 11, 2007, the entire contents of which are incorporated herein by reference.

BACKGROUND

1. Technical Field

The present disclosure generally relates to biomedical electrodes and, in particular, relates to various biomedical electrode connectors each for effecting an electrical connection between an electrode on a patient and an electro-medical device.

2. Discussion of Related Art

Biomedical electrodes are commonly used in diagnostic and therapeutic medical applications including, e.g., electrocardiograph procedures, maternal and/or fetal monitoring, and a variety signal based rehabilitative procedures. A conventional biomedical electrode is secured to the skin of a patient via an adhesive and incorporates a male terminal or pin which projects from an electrode base. An electrical cable in communication with the electro-medical device incorporates a female terminal which is connected to the male terminal to complete the electrical circuit between the electrode and the electro-medical device. Various mechanisms for connecting the female terminal to the male terminal are known including "snap on" connections, "pinch clip" arrangements, "twist on" couplings or magnetic couplings. Many, if not all, currently available biomedical electrodes are disposable, i.e., intended to be discarded after a single use.

SUMMARY

Accordingly, the present disclosure is directed to a biomedical electrode connector for coupling with a biomedical electrode of the type including an electrode base and a male terminal projecting from the electrode base. In one embodiment, the electrode connector includes a connector element having first and second leg segments and a bend segment connecting the first and second leg segments. The first and second leg segments each include inner surface portions defining terminal receiving apertures therethrough and having serrations at least partially circumscribing the apertures. The first and second leg segments are adapted for relative movement between an open position whereby the male terminal is permitted to pass through the apertures of the first and second leg segments and a lock position whereby the inner surface portions including the serrations engage the male terminal in secured relation therewith to mount the connector element to the electrode.

The inner surface portions of the first and second leg segments may each define elongated terminal receiving apertures having a first internal dimension adjacent the bend segment greater than a corresponding second internal dimension displaced from the bend segment. The serrations of the inner surface portions of the first leg segment may at least partially circumscribe the aperture at a location adjacent the bend segment and the serrations of the inner surface portions of the second segment may at least partially circumscribe the aperture at a location displaced from the end segment. The serrations of the inner surface portions of the first and second leg segments may be disposed in general diametrically opposed relation. The inner surface portions of the first and second leg segments may each define elongated terminal receiving apertures having a substantially ovoid shape. The first and second leg segments may be normally biased to the lock position.

In another embodiment, the biomedical electrode connector includes a connector element having inner surface portions defining a terminal receiving aperture therethrough. The connector element includes a connector base adapted to establish electrical communication with the terminal receiving aperture and a connector shoe mounted to the base. The connector shoe includes a friction enhancing material adapted to contact the electrode base upon positioning of the connector element onto the biomedical electrode to minimize movement of the connector element relative to the male terminal of the biomedical electrode. The connector shoe may comprise an elastomeric material.

The connector element may include first and second jaw sections. The first and second jaw sections are adapted for relative movement to increase an internal dimension of the terminal receiving aperture to facilitate mounting of the connector element onto the biomedical electrode. The first and second jaw sections may be adapted for relative pivotal movement.

In another embodiment, the biomedical electrode connector includes a connector element having first and second leg segments and a bend segment connecting the first and second leg segments. The first and second leg segments each include at least one hemispherical segment depending outwardly from the respective leg segment. The at least one hemispheric segments of the first and second leg segments are generally aligned to define a terminal receiving aperture therethrough. The first and second leg segments are adapted for relative movement between an open position whereby the male terminal is permitted to pass through the terminal receiving aperture of the first and second leg segments and a lock position whereby inner surface portions of the hemispherical segments engage the male terminal in secured relation therewith to mount the connector element to the electrode. The first and second leg segments may be normally biased to the lock position.

In another embodiment, a biomedical electrode connector includes a connector element having a coiled segment defining a terminal receiving aperture and a sheath at least partially mounted about the connector element. The sheath is adapted to assume a first relative position with respect to the connector element whereby the terminal receiving aperture of the coiled segment defines a first internal dimension to permit passage of the male terminal therethrough and a second relative position with respect to the connector element whereby the terminal receiving aperture defines a second internal dimension with the coiled segment contacting the male terminal of the electrode in secured relation therewith. The connector element includes connector ends depending from the coiled segment. The connector ends are engaged and manipulated by the sheath when the sheath is in the first and second relative positions to cause the terminal receiving aperture to correspondingly assume the first and second internal dimensions. The coiled segment may be normally biased to assume the second internal dimension.

The sheath may include a first pair of diametrically opposed lobes and a second pair of diametrically opposed lobes. The connector ends of the connector member are at least partially received within the first pair of lobes when the sheath is in the first relative position and are at least partially received within the second pair of lobes when the sheath is in the second relative position.

The sheath may be adapted for rotational movement relative to the connector ends of the connector member to move between the first and second relative positions. The sheath may define a general elliptical cross-section having a minor axis and a major axis. The connector ends are positioned in general alignment with the minor axis when the sheath is in the first relative position and are positioned in alignment with the major axis and in spaced relation when the sheath is in the second relative position. The sheath includes internal locking shelves to assist in retaining the connector ends in alignment with the respective major and minor axes.

Alternatively, the sheath may be adapted for longitudinal movement relative to the connector element to cooperatively engage the connector ends and cause the coiled segment to respectively assume the first and second relative positions. In this embodiment, the sheath includes an internal tapered surface engageable with the connector ends to cause the connector ends to assume an approximated relation upon movement of the sheath to the first relative position and to permit the connector ends to assume a spaced relation upon movement of the sheath to the second relative position.

BRIEF DESCRIPTION OF THE DRAWINGS

The accompanying drawings, which are incorporated in and constitute a part of this specification, illustrate embodiments of the disclosure and, together with a general description of the disclosure given above, and the detailed description of the embodiment(s) given below, serve to explain the principles of the disclosure, wherein.

DETAILED DESCRIPTION OF THE PREFERRED EMBODIMENT(S)

The exemplary embodiments of the electrode connectors disclosed herein are intended for use with a lead set assembly in performing a surgical, diagnostic or therapeutic procedure in collecting or delivering electrical signals relative to a subject. Such procedures are inclusive of, but, not limited to, electrocardiograph procedures, maternal and/or fetal monitoring, and a variety of signal based rehabilitative procedures. However, it is envisioned that the present disclosure may be employed with many applications including surgical, diagnostic and related treatments of diseases, body ailments, of a subject.

In the discussion that follows, the term "subject" refers to a human patient or other animal. The term "clinician" refers to a doctor, nurse or other care provider and may include support personnel.

Figure 1:
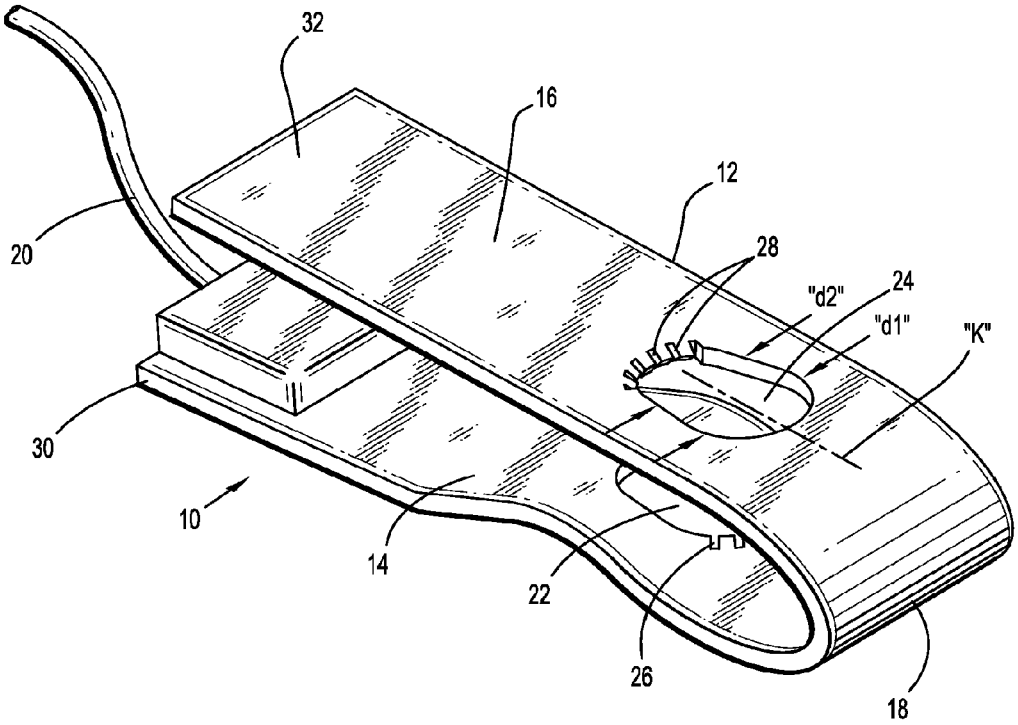
FIG. 1 is a perspective view of an electrode connector in accordance with the principles of the present disclosure for use with a biomedical electrode lead set assembly.

Referring now to the drawings wherein like components are designated by like reference numerals throughout the several views, FIG. 1 illustrates, in perspective view, an electrode connector 10 in accordance with the principles of the present disclosure. Electrode connector 10 is intended for use with an electrode lead set assembly for connecting a biomedical electrode with a diagnostic or monitoring apparatus as will be further discussed hereinbelow. Electrode connector 10 includes connector element 12 comprising at least in part a conductive material and being arranged in a bent or folded condition to define first and second legs 14, 16 connected through bend 18. First and second legs 14, 16 may be arranged at an angle ranging from about 105 degrees to about 165 degrees, preferably, about 135 degrees. First leg 14 has electrical lead wire 20 connected thereto. Any means for connecting lead wire 20 to first leg 14 are envisioned including, but, not limited to, crimping methodologies, adhesives, and any other electro-mechanical connections envisioned by one skilled in the art.

First and second leg 14, 16 define respective apertures 22, 24 which are in general alignment with each other. Apertures 22, 24 are elongated and may define a variety of shapes including a general egg shape or general ovoid shape. In one embodiment, apertures 22, 24 each define an internal dimension or diameter "d1" which is greater adjacent bend 18 than the corresponding internal dimension or diameter "d2" of the apertures 22, 24 displaced from the bend 18. Apertures 22, 24 may gradually taper to define the general ovoid shape, and may be symmetrically arranged about a longitudinal axis "k" of symmetry. First leg 14 may have serrations or cuts 26 circumscribing one longitudinal end of aperture 22, e.g., adjacent loop 18, and second leg 16 may have corresponding serrations or cuts 28 circumscribing the opposed longitudinal end of aperture 24.

Electrode connector 10 is preferably formed of a conductive metal such as copper, stainless steel, titanium and alloys thereof, and may be manufactured via known techniques including coining, stamping or pressing or any other suitable manufacturing technique.

Figure 2:
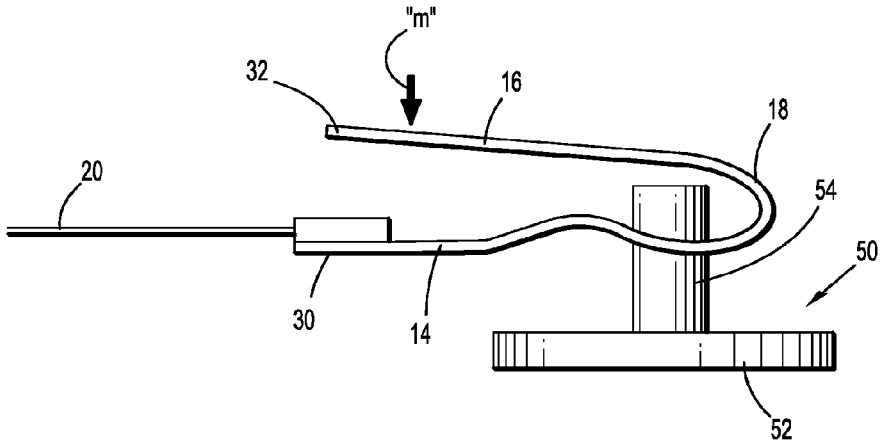
FIG. 2 is a side elevational view of the electrode connector of FIG. 1 illustrating placement of the electrode connector over a male terminal of the biomedical electrode.

Referring now to FIG. 2, electrode connector 10 is shown being positioned adjacent biomedical electrode 50. Biomedical electrode 50 incorporates electrode flange or base 52 and male pin or terminal 54 extending in transverse relation to the electrode base 52. Male terminal 54 may have a bulbous arrangement whereby the upper portion of the male terminal 54 has a greater cross-sectional dimension than a lower portion of the male terminal 50. A pressure sensitive adhesive coating and an adhesive hydrogel (not shown) may be applied to tissue contacting surface of electrode base 52 to enhance the electrical connection to the subject to receive/transmit the biomedical signals to/from the subject. Any commercially available biomedical electrode 50 having an upward extending male terminal or pin 54 may be utilized.

Figure 6:
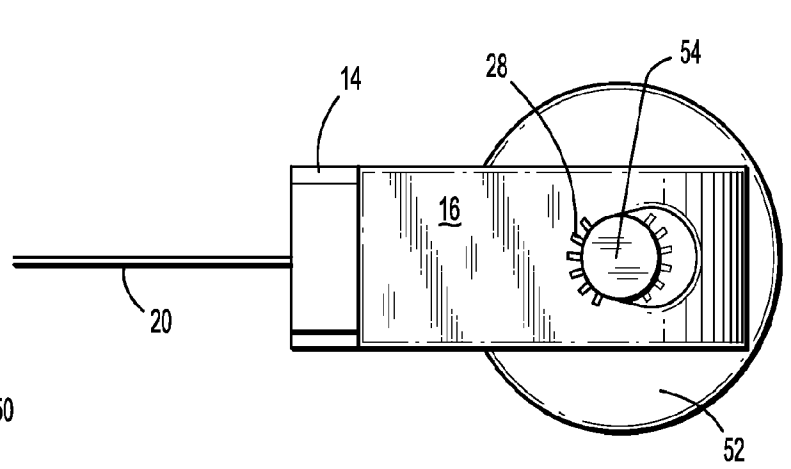
FIGS. 5-6 are top and side elevational views of the electrode connector positioned about the male terminal of the biomedical electrode and in a secured position with respect to the male terminal.
Figure 4:
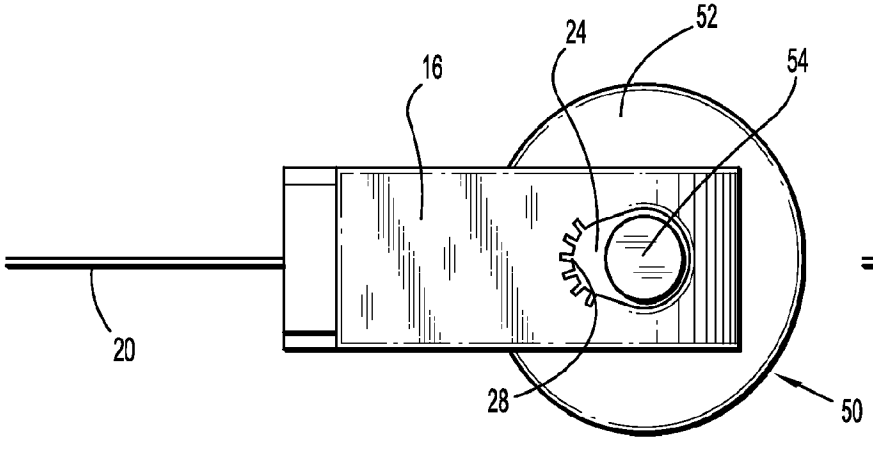
FIGS. 3-4 are top and side elevational views of the electrode connector positioned about the male terminal of the biomedical electrode and in an unsecured position with respect to the male terminal.
Figure 5:
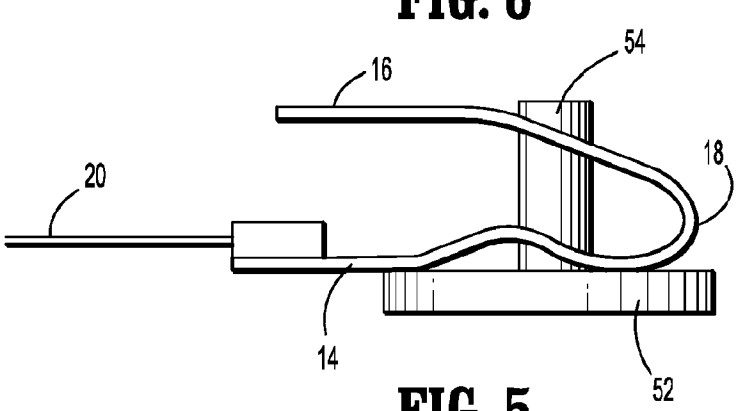
Figure 3:
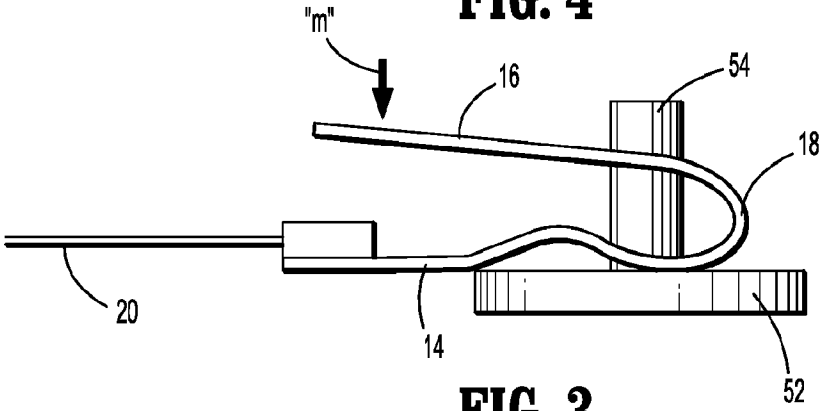

Referring now to FIGS. 2-4, to secure electrode connector 10 to biomedical electrode 50, apertures 22, 24 of first and second legs 14, 16 are generally aligned with male terminal 54, and free ends 30, 32 of respective first and second legs 14, 16 are moved toward each other, by, for example, a squeezing action as shown by directional arrow "m" of FIGS. 2 and 3 on one or both of respective free ends 30, 32 of the first and second legs 14, 16. In this position, apertures 22, 24 are generally parallel to each other to receive male terminal 54 with minimal force. With electrode connector 10 positioned about male terminal 54, legs 14, 16 are released causing the legs 14, 16 to displace by virtue of the resiliency or spring action of bend 18 to assume the normal condition of FIGS. 5 and 6. In this position, serrations 26, 28 adjacent first and second apertures 22, 24 contact opposed sections of male terminal 54, and, may bite into the male terminal 54. Serrated edges or serrations 26, 28 provide multiple contact surfaces for electrical conduction between electrode connector 10 and male terminal 54 of electrode 50. In addition, serrated edges 26, 28 provide a mechanical connection between electrode connector 10 and male terminal 54, thereby minimizing the potential of lead wire pop-off. In order to remove electrode connector 10, first and second legs 14, 16 are squeezed or displaced toward each other such that serrated edges 26, 28 disengage male terminal 54 and apertures 22, 24 assume a general parallel orientation. In this position with male terminal 54 unconstrained, minimal force is required to remove electrode connector 10 from biomedical electrode 50.

Figure 7:
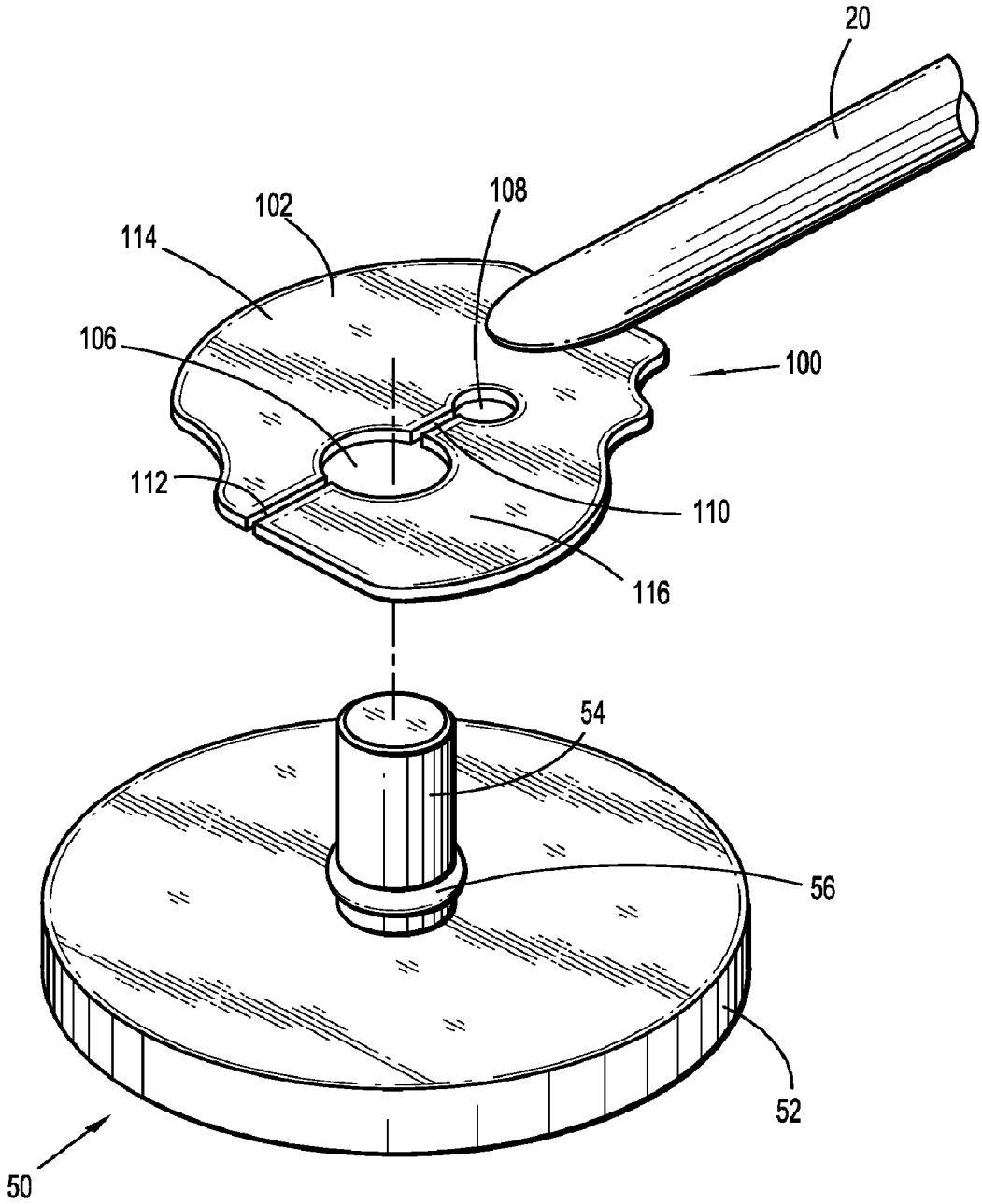
FIG. 7 is a top perspective view of an alternate embodiment of the electrode connector of FIG. 1.
Figure 8:
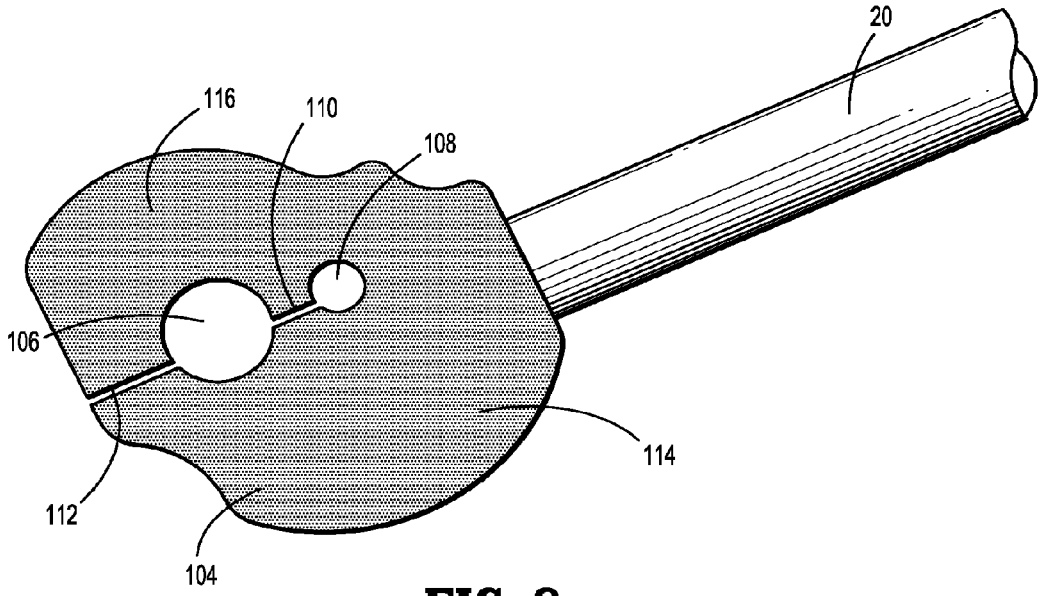
FIG. 8 is a bottom perspective view of the electrode connector of FIG. 7.

FIGS. 7-8 illustrate an alternate embodiment of an electrode connector 100. Electrode connector 100 includes connector base 102 formed of a conductive metal substrate and connector shoe 104 which is secured, connected, or otherwise adhered, to the surface of the connector base 102. Connector shoe 104 may be fabricated from an elastomeric material, and manufactured via known molding techniques. Connector shoe 104 provides a friction enhancing surface to contact electrode base 52 and minimize rotational movement of electrode connector 100 about biomedical electrode 50 when the electrode connector 100 is mounted to the biomedical electrode 50. It is further envisioned that connector base 102 may be incorporated within connector shoe 104 through insert molding applications. Other materials for connector shoe 104 may be cloth materials, fabrics and/or polymeric materials or combinations thereof. Connector base 102 is in electrical communication with lead wire 20 and may be connected to the lead wire 20 through any of the aforementioned connection means.

Electrode connector 100 includes terminal aperture 106, hinge aperture 108 and slits 110,112 each of which extend through connector base 102 and connector shoe 104. Terminal aperture 106 defines a generally circular configuration and is adapted to receive male terminal 54 of biomedical electrode 50. Electrode connector 100 further defines first and second jaw sections 114, 116 on each side of slits 110, 112 which move between the closed position of FIGS. 7 and 8 and the open condition of FIG. 9. In particular, first and second jaw sections 114, 116 pivot about hinge aperture 108 to permit terminal aperture 106 to expand in dimension upon placement about male terminal 54 of biomedical electrode 50.

Figure 9:
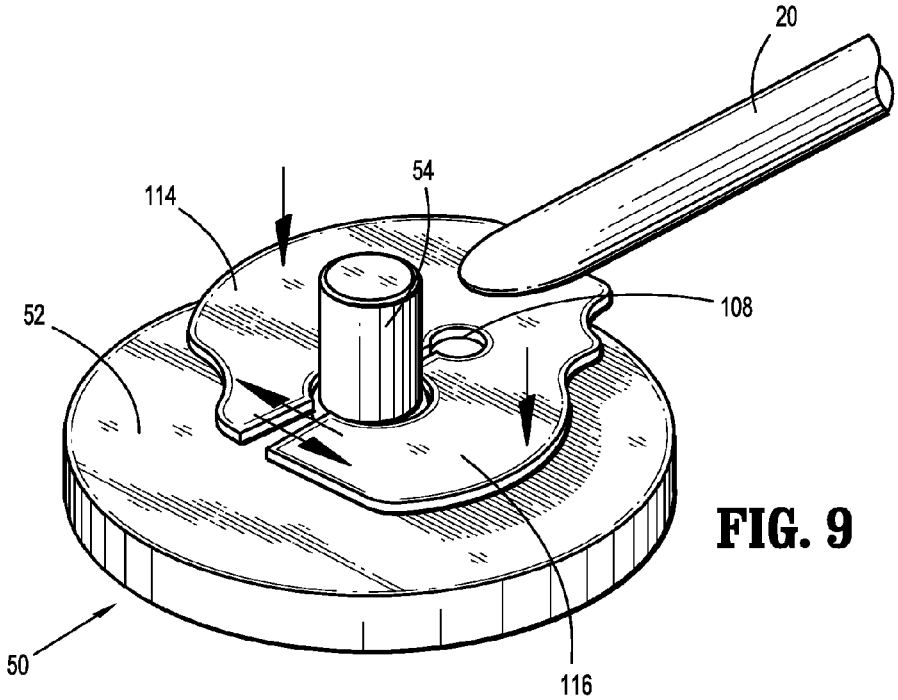
FIG. 9 is a perspective view of the electrode connector of FIG. 7 during positioning about the male terminal of the biomedical electrode.
Figure 10:
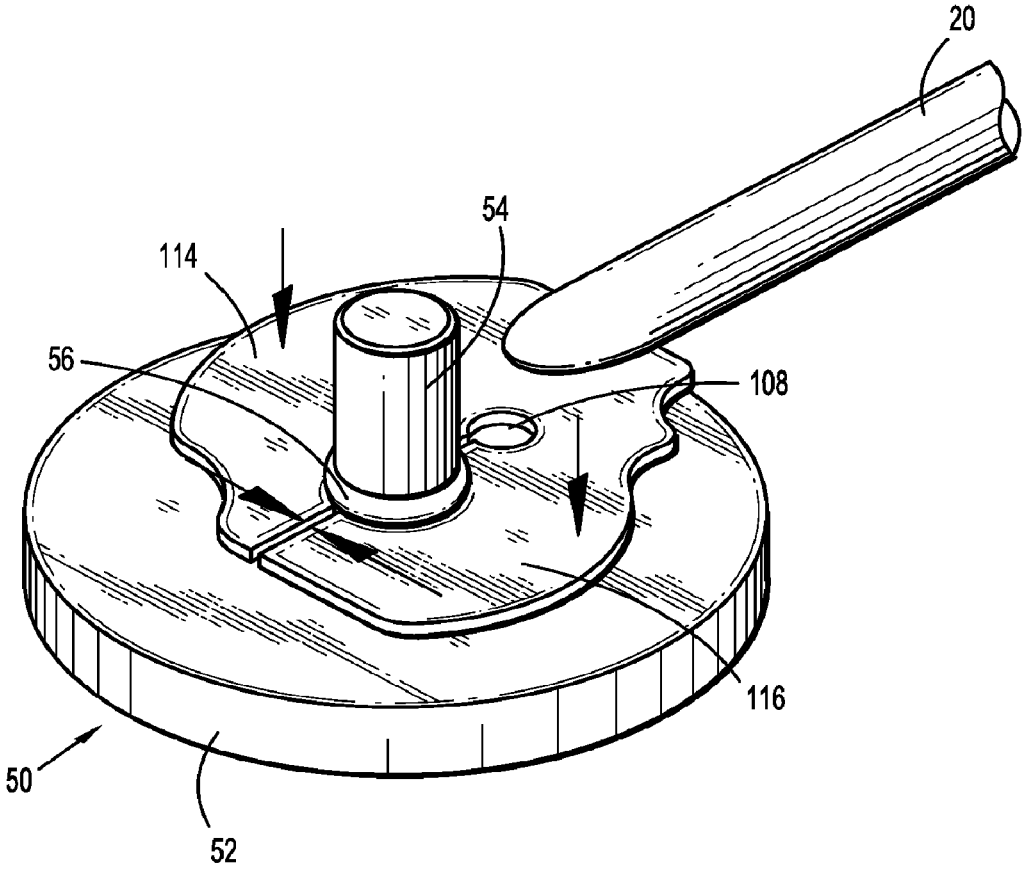
FIG. 10 is a perspective view of the electrode connector of FIG. 7 in a secured position with respect to the male terminal of the biomedical electrode.

In use, electrode connector 100 is positioned adjacent biomedical electrode 50 with terminal aperture 106 in alignment with male terminal 54 and connector shoe 104 facing electrode base 52. As depicted in FIG. 9, a downward application of pressure is applied to electrode connector 100 whereby first and second jaw sections 114, 116 engage male terminal 54 and pivot outwardly away from each other to increase the dimension of terminal aperture 106. Due to the normal bias of first and second jaw sections 114, 116 towards the first initial condition shown, the inner surfaces of the jaw sections 114, 116 defining terminal aperture 106 engage male terminal 54 in frictional secured relation therewith. Electrical communication may be established by virtue of direct contact of male terminal 54 and the inner conductive surfaces of connector base 102 defining terminal aperture 106. In one embodiment, the diameter or cross-sectional dimension of male terminal 54 is slightly less than the diameter of internal dimension of terminal aperture 106 to create an sufficient electro-mechanical connection through, e.g., a frictional or tolerance fit. In another embodiment, male terminal 54 may incorporate a circumferential rib 56 adjacent electrode base 52 to further assist in establishing the electrical connection as depicted in FIG. 10. Specifically, circumferential rib 56 may be conductive and contact the upper surface of connector base 102. In addition, circumferential rib 56 may assist in retention of electrode connector 100 on biomedical electrode 50 through engagement of the circumferential rib 56 with the upper surface of electrode base 102. Connector shoe 104 is in engagement with electrode base 52 and through the friction enhancing qualities of the connector shoe 104 minimizes at least rotational movement of electrode connector 100 relative to biomedical electrode 50. This feature may prevent "pop off" of electrode connector 100 relative to biomedical electrode 50.

Figure 11:
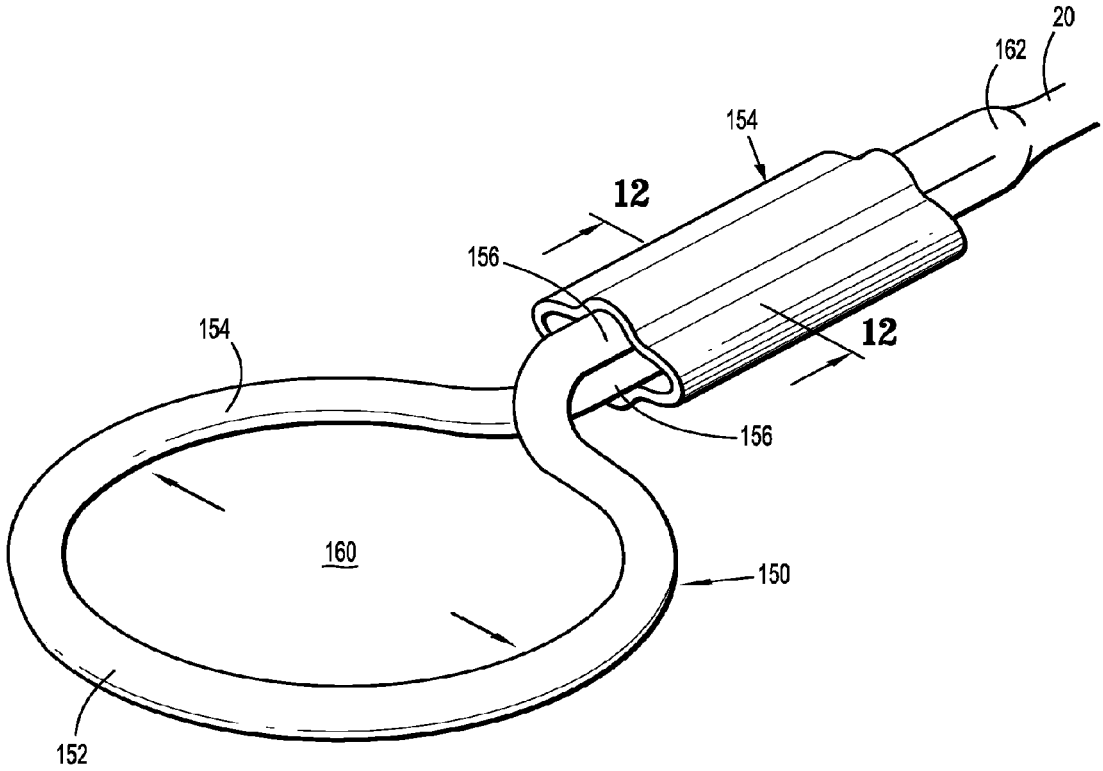
FIG. 11 is a perspective view of another alternate embodiment of the electrode connector incorporating a connector element with coiled segment and a sheath, and illustrating the first position of the sheath relative to the connector element.
Figure 12:
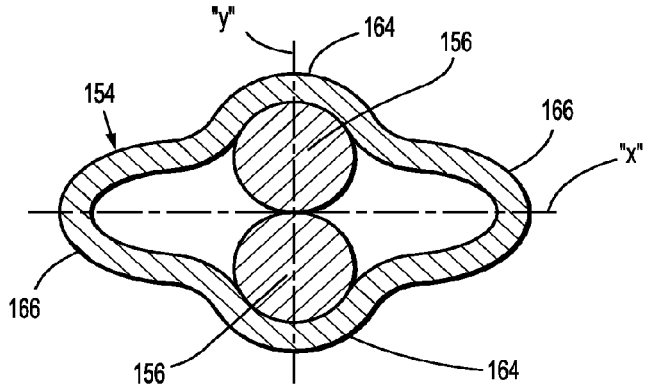
FIG. 12 is a cross-sectional view taken along lines 12-12 of FIG. 11 illustrating the approximated arrangement of the connector ends within the sheath when the sheath is in the first relative position.

FIGS. 11-12 illustrate another alternate embodiment of an electrode connector. Electrode connector 150 includes connector element 152 and sheath 154 mounted about the connector element 152. Connector element 152 consists of coiled segment 156 and connector ends 158 depending from the coiled segment 156 and extending through sheath 154. Coiled segment 156 defines terminal receiving aperture 160 therethrough having an internal dimension or diameter which is variable to assist in placement about, and securement to, male terminal 54 of biomedical electrode 50. Coiled segment 156 overlaps adjacent connector ends 158 whereby the connector ends 158 extend in a general longitudinal direction through sheath 154 to proximal junction point, identified by reference numeral 162. At this juncture point 162, connector ends 158 may be joined to lead wire 20. Connector ends 158 may be connected to each other and/or lead wire 20 by crimping procedures or any other known methodologies, or may connect adjacent the monitor jack.

Connector element 152 is fabricated from a suitable conductive metal and exhibits a degree of resiliency to assist in securing coiled segment 156 about male terminal 54 of biomedical electrode 50.

Sheath 154 may be formed of a relatively rigid material having some flexibility and a degree of elasticity. Suitable materials for sheath 154 include polymeric materials such as polycarbonates and/or polystyrenes. Sheath 154 may be formed by known injection molding techniques. Sheath 154 has a non-circular cross-section, and may define a major axis "x" having a major dimension and a minor axis "y" having a minor dimension less than the major dimension. Sheath 154 is adapted to receive connector ends 158 of connector element 152 and incorporates first and second pairs 164, 166 of lobes. Lobes 164 of the first pair extend along the minor axis "y" of sheath 154 in relative diametrical opposed relation and lobes 166 of the second pair extend along major axis "x" of the sheath 154 also in relative diametrical opposed relation. In a first position of sheath 154 relative to connector element 152 as depicted in FIGS. 11-12, connector ends 156 are received within respective lobes 164 of the first pair and arranged in approximated or adjacent, e.g, contacting, relation. In the first relative position, coiled segment 156 defines a first internal dimension or diameter.

Figure 13:
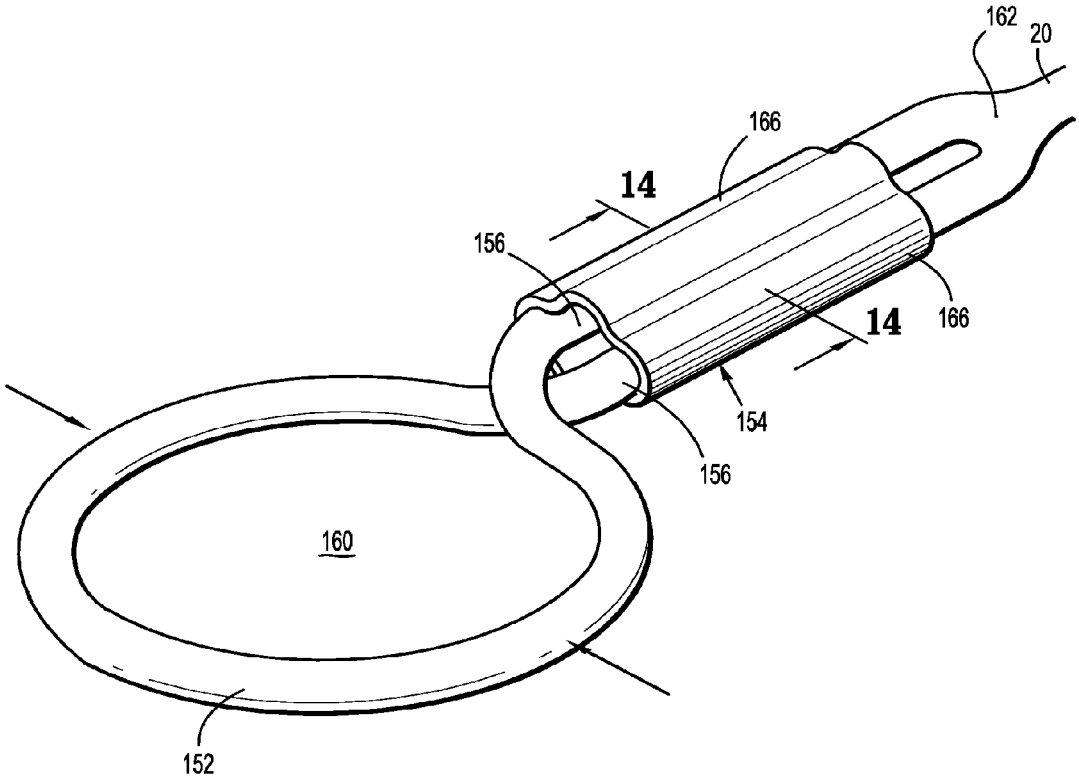
FIG. 13 is a perspective view similar to the view of FIG. 11 illustrating the second position of the sheath relative to the connector element.
Figure 14:
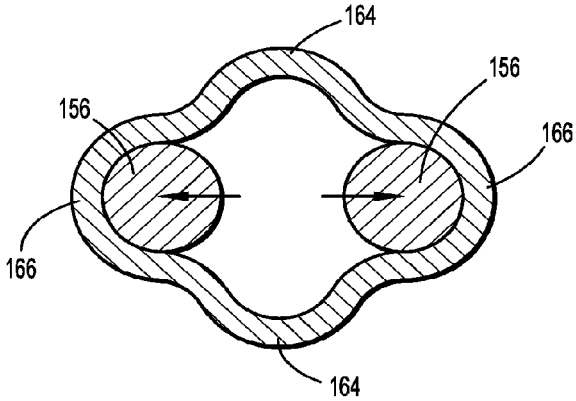
FIG. 14 is a cross-sectional view taken along lines 14-14 of FIG. 13 illustrating the approximated arrangement of the connector ends within the sheath when the sheath is in the second relative position.

FIGS. 13-14 illustrate a second position of sheath 154 relative to connector element 152. In the second relative position, connector ends 158 are received within lobes 166 of the second pair in spaced relation as shown. In the second relative position, coiled segment 156 defines a second internal dimension or diameter less than the first internal dimension defined when sheath 154 is in the first relative position. Connector element 150 may be normally biased toward this arrangement of connector ends 158 and coiled segment 156 due to the inherent resiliency of the material of fabrication of the connector element 150.

The use of electrode connector 150 will now be discussed. As indicated hereinabove, connector element 150 is normally biased toward the condition depicted in FIGS. 13-14 due to the inherent resiliency and arrangement of connector element 150. In this condition which corresponds to the second relative position of sheath 154, coiled segment 156 defines the second internal dimension. The second internal dimension of coiled segment 156 will generally approximate or be less than the cross-sectional dimension of male terminal 54 of biomedical electrode 50 thereby preventing placement over the male terminal 54. Accordingly, the operator will need to enlarge coiled segment 156 of connector element 150.

With reference to FIGS. 13-14, enlargement of coiled segment 156 may be achieved by depressing sheath 154 adjacent lobes 166 and connector ends 158 which are disposed within the lobes 166 to displace the connector ends 158 toward each other. Upon approaching the center of sheath 154, connector ends 158 are no longer constrained within lobes 166 and are free to enter lobes 164 of the first pair of sheath 154 and are releasably secured therein by the corresponding internal dimensioning of the lobes 164 and the connector ends 158. It is noted that a slight angular or twisting action on sheath 154 and connector ends 158 may facilitate positioning of the connector ends 158 within lobes 164. Thus, with sheath 154 now in the first relative position of FIGS. 11-12, connector ends 158 are approximated and coiled segment 156 is enlarged to define the first relatively large internal dimension.

Figure 15:
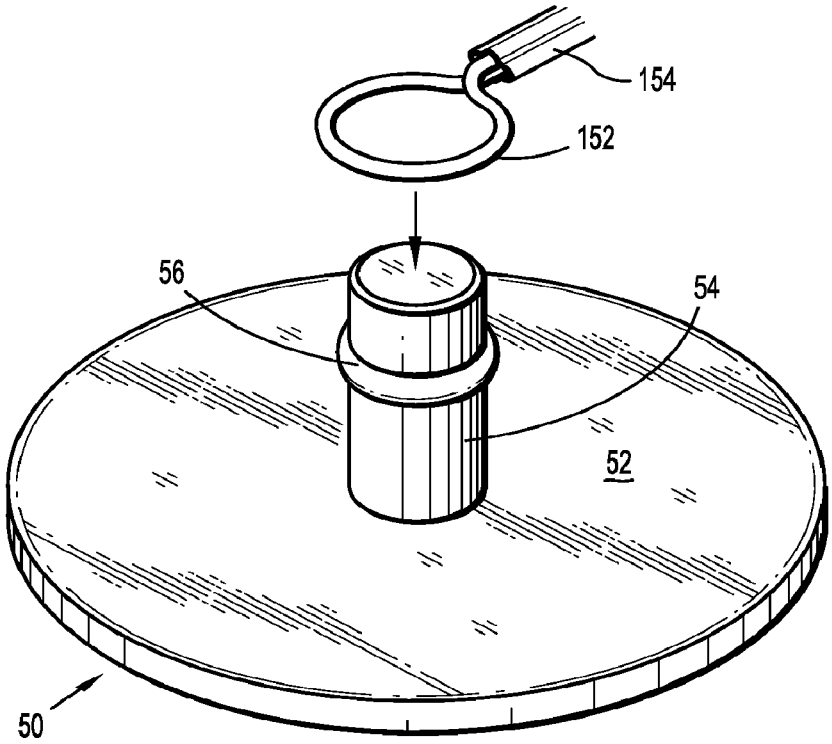
FIG. 15 is a perspective view of the electrode connector of FIG. 11 illustrating placement of the electrode connector over a male terminal of the biomedical electrode while the sheath is in the first relative position.

With reference now to FIG. 15, coiled segment 156 is then positioned over male terminal 54 of biomedical electrode 50. Thereafter, coiled segment 156 is secured about male terminal 54 by applying a force on sheath 154 adjacent second lobes 164 and connector ends 158 to move the connector ends 158 toward second lobes 166. As noted above, due to the normal bias of connector ends 158 toward a relative spaced arrangement, the connector ends 158 have a tendency to fall or enter into second lobes 166 to assume the normal condition of connector element 152 corresponding to the second relative position of sheath 154. An angulated diametrically opposed force or twisting action adjacent lobes 164 on sheath 152 may be applied to assist in directing connector ends 158 toward second lobes 166. In this condition of connector element 150, coiled segment 156 securely engages male terminal 54 to establish electrical contact with biomedical electrode 50.

Figure 16:
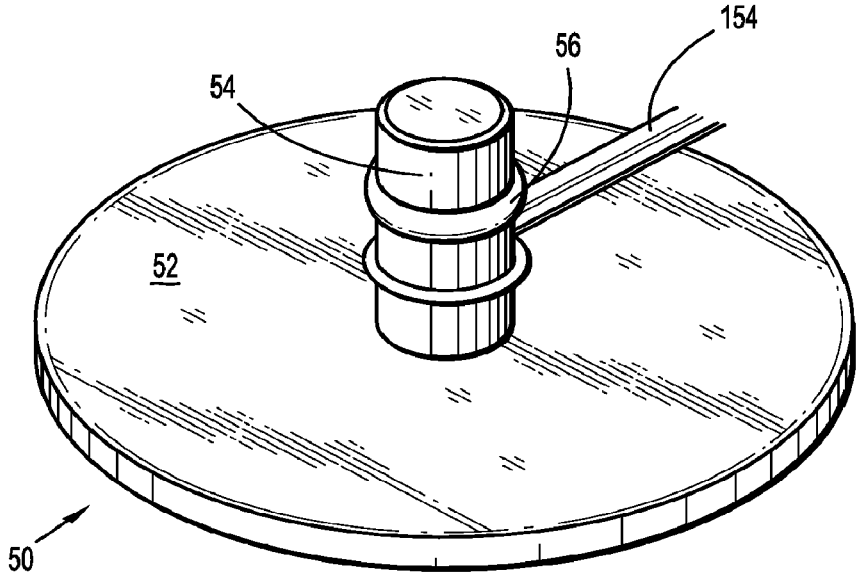
FIG. 16 is a perspective view of the electrode connector of FIG. 11 illustrating securement of the electrode connector about the male terminal of the biomedical electrode while the sheath is in the second relative position.

FIG. 16 illustrates the secured position of coiled segment 156 about male terminal 54 of biomedical electrode 50. It is noted that male terminal 54 may include a circumferential rib 56 to assist in maintaining coiled segment 156 about the male terminal 54 of biomedical electrode 50. Circumferential rib 56 may be integrally formed with male terminal 54 or be a separate unit positionable on the male terminal 54 and capable of establishing a close tolerance fit with the male terminal 54.

FIGS. 17-20 illustrate an alternate embodiment of an electrode connector. Electrode connector 200 includes connector element 202 and rotating sheath 204 at least partially positionable about the connector element 202. Connector element 202 is substantially similar to connector element 152 discussed in connection with the embodiment of FIGS. 11-16, and reference is made to the foregoing description for details of the connector element 202. Rotating sheath 204 is at least partially positionable about connector ends 206. Rotating sheath 204 defines an oblong or elliptical cross-section having a minor axis "y" and a major axis "x" with respective minor and major dimensions. The major dimension is greater than the minor dimension.

Figure 17:
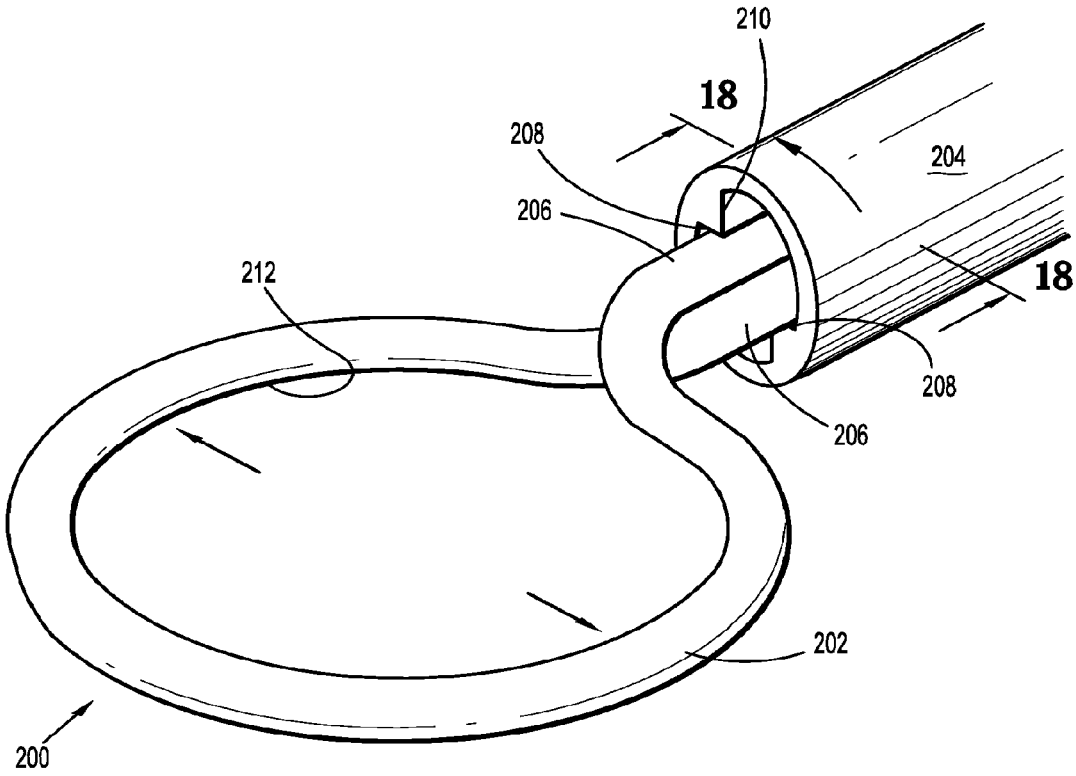
FIG. 17 is a perspective view of another alternate embodiment of the electrode connector incorporating a connector element and a rotating sheath, and illustrating the first position of the rotating sheath relative to the connector element.
Figure 18:
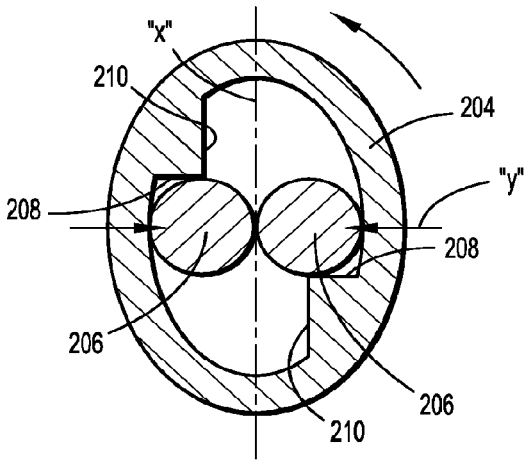
FIG. 18 is a cross-sectional view taken along lines 18-18 of FIG. 17 illustrating the approximated arrangement of the connector ends within the rotating sheath when the rotating sheath is in the first relative position.
Figure 19:
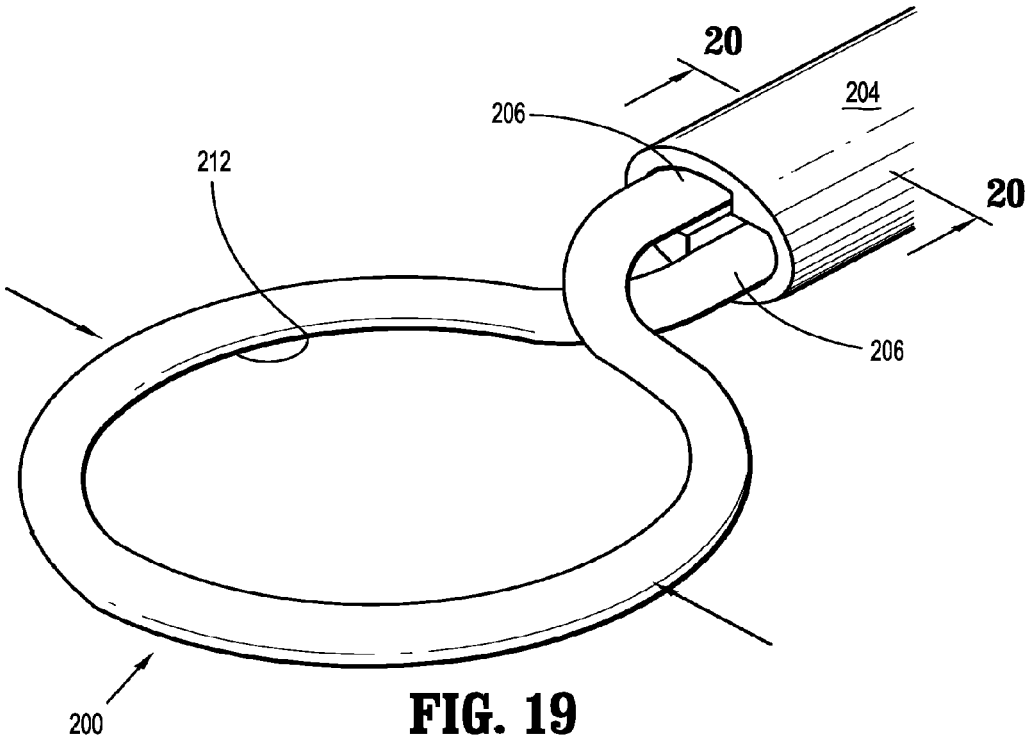
FIG. 19 is a perspective view similar to the view of FIG. 17 illustrating the second position of the rotating sheath relative to the connector element.
Figure 20:
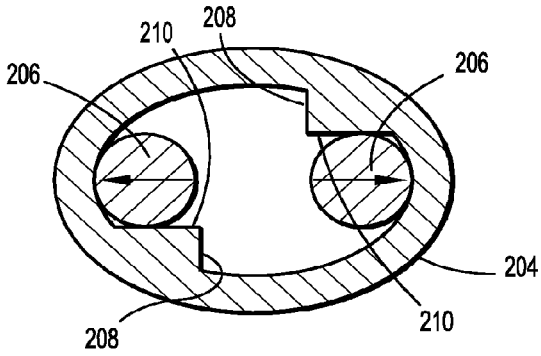
FIG. 20 is a cross-sectional view taken along lines 20-20 of FIG. 19 illustrating the spaced arrangement of the connector ends within the rotating sheath when the rotating sheath is in the second relative position.

Rotating sheath 204 is adapted to rotate about its longitudinal axis between a first position relative to connector element 202 as depicted in FIGS. 17-18 and a second position relative to the connector element 202 as depicted in FIGS. 19-20. Rotating sheath 204 includes internal minor locking shelves 208, e.g., in general parallel relation with the minor axis "y", and internal major locking shelves 210, e.g., in general parallel relation with the major axis "x". When sheath 204 is in the first relative position, connector ends 206 are generally approximated causing coiled segment 212 to assume its enlarged condition of FIGS. 17-18 in a similar manner discussed in connection with the embodiment of FIGS. 11-16. Minor locking shelves 208 assist in retaining connector ends 206 in the approximated position during placement of coiled segment 212 about male terminal 54 of biomedical electrode 50. Once coiled segment 212 is positioned over male terminal 54, rotating sheath 204 is rotated in either direction causing locking shelves 210 to begin to displace connector ends 206 in an angular direction. As discussed hereinabove, connector ends 206 are normally biased away from each other; therefore, once connector ends 206 clear minor locking shelves 208 during angular movement, the connector ends 206 assume their fully spaced relationship relative to each other under the natural bias of connector element 202 to assume the position depicted in FIGS. 19-20. This position corresponds to the second position of rotating locking sheath 204 relative to connector element 202. In this position, coiled segment 212 is secured about male terminal 54 of biomedical electrode 50. Major locking shelves 210 assist in retaining connector ends 206 in the spaced position thereby maintaining coiled segment 212 in secured relation about male terminal 54 of biomedical electrode 50.

Figure 21:
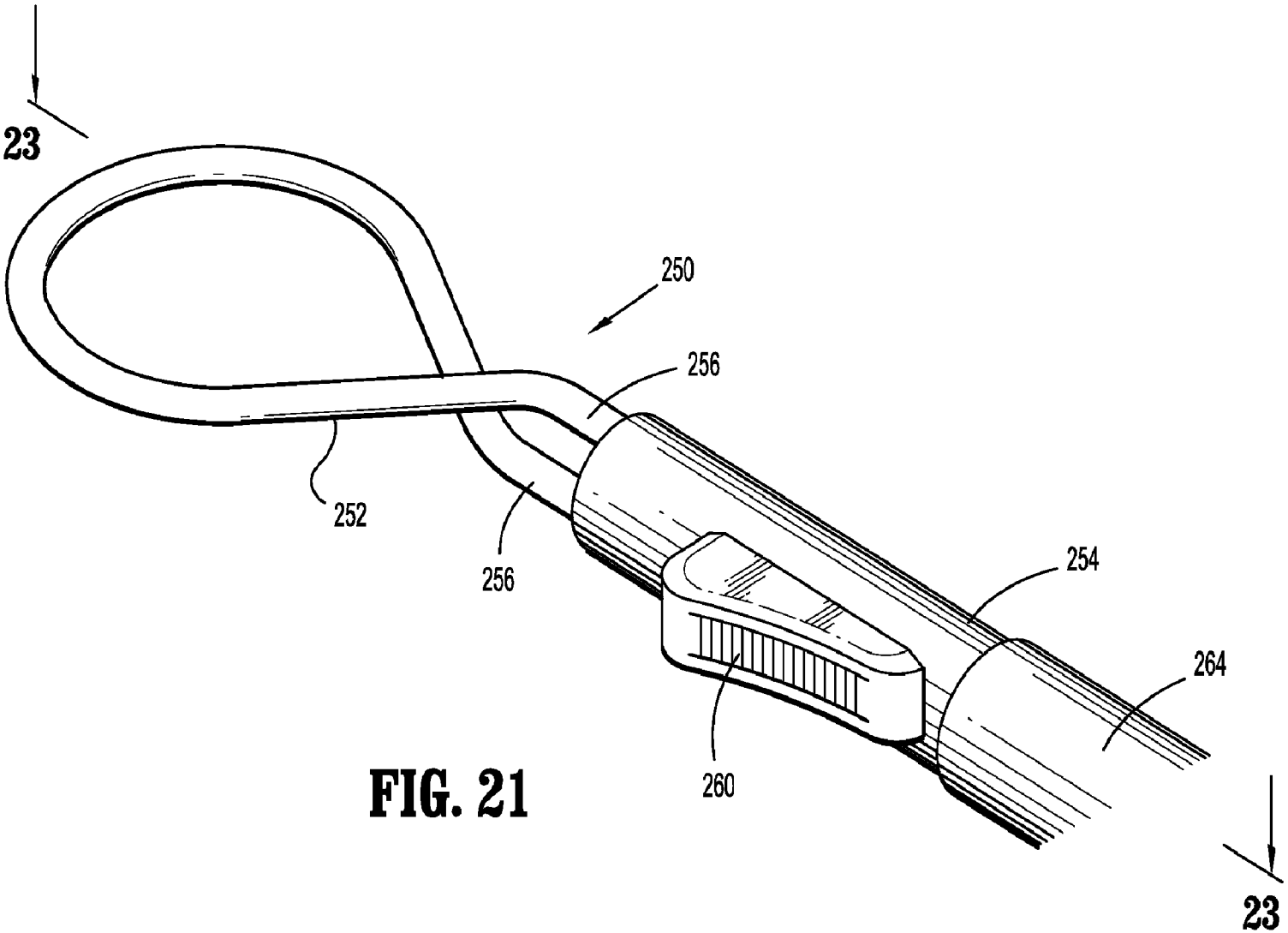
FIG. 21 is a perspective view of another alternate embodiment of the electrode connector incorporating a connector element and a sliding sheath.
Figure 22:
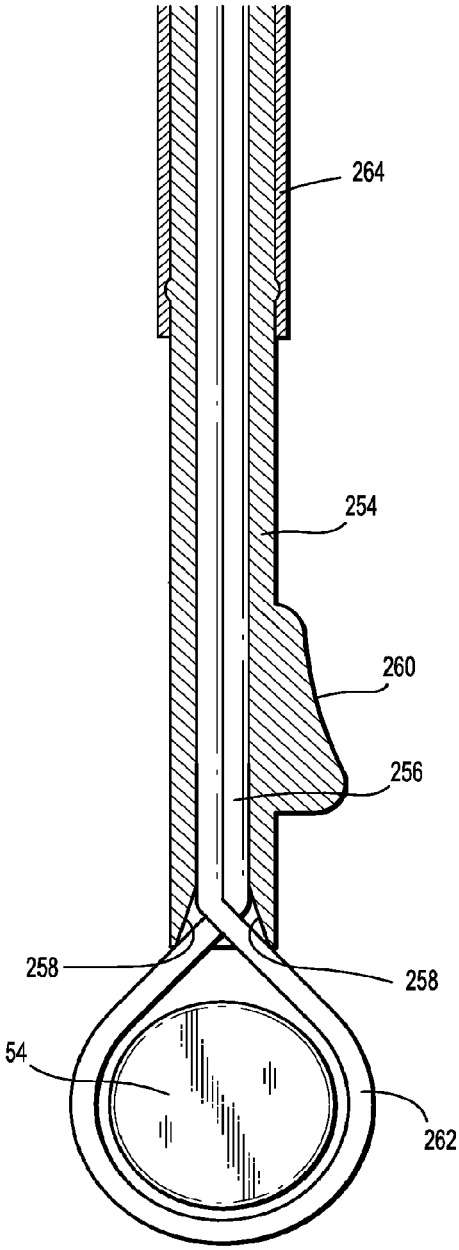
FIG. 22 is a side cross-sectional view of the electrode connector of FIG. 21 illustrating the sliding sheath in the first relative position.
Figure 23:
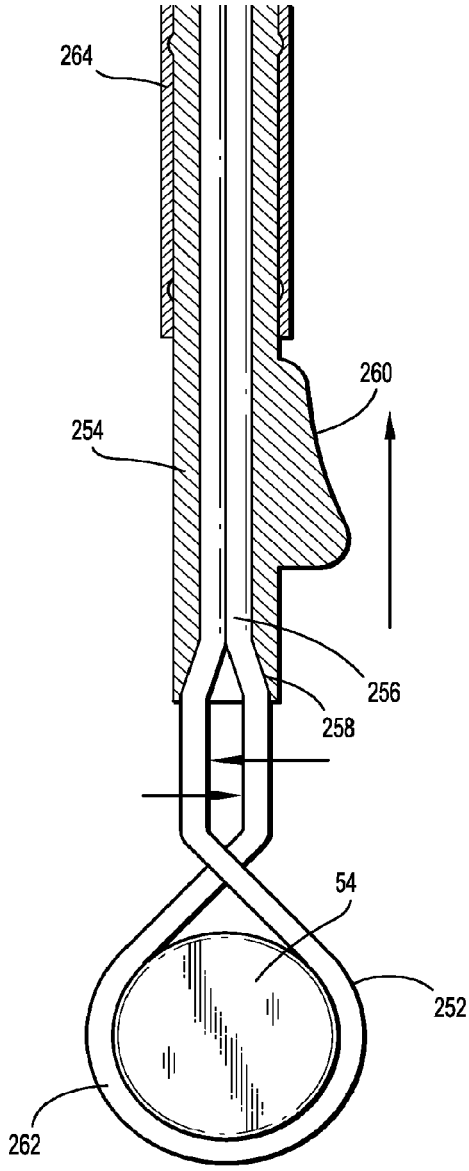
FIG. 23 is a side cross-sectional view of the electrode connector of FIG. 21 illustrating the sliding sheath is in the second relative position.

FIGS. 21-23 illustrate an alternate embodiment of an electrode connector. Electrode connector 250 includes connector element 252 and sliding sheath 254 at least partially positionable about the connector element 252. Connector element 252 is substantially similar to connector element 152 discussed in connection with the embodiment of FIGS. 11-16, and reference is made to the accompanying description for details of the connector element 252. Sliding sheath 254 is at least partially positionable about connector ends 256. Sliding sheath 254 is adapted to translate in a general longitudinal direction relative to connector ends 256 of connector element 252 between the first relative position depicted in FIG. 22 and the second relative position depicted in FIG. 23. Sheath 254 may incorporate internal taper or cam surfaces 258 to facilitate in approximating connector ends 256 when moving the sheath 254 toward the first relative position of FIG. 22. Sheath 254 may include external handle or tab 260 adapted for manual engagement by the operator. In the first relative position, coiled segment 262 of connector element 252 defines an enlarged diameter or internal dimension to be positioned over male terminal 54 of biomedical electrode 50. Once coiled segment 252 is positioned on male terminal 54, sheath 254 is moved in the direction of the directional arrow of FIG. 23 to the second relative position whereby taper surfaces 258 release connector ends 256 to permit connector element 252 to assume its normally biased closed position.

In addition, electrode connector 250 may include frame 264 engageable with one hand of the operator while the operator manipulates sheath 254. Frame 264 may be secured to one or both extreme ends of connector ends 256 within the internal surface of frame 254 or at a connection point of the connector ends 256 with lead wire 20. Frame 264, thus, may be stationary relative to connector ends 256.

Figure 24:
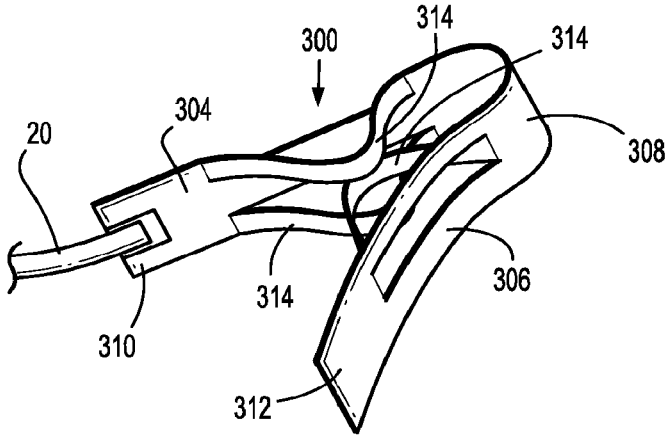
FIG. 24 is a perspective view of another alternate embodiment of the electrode connector.
Figure 25:
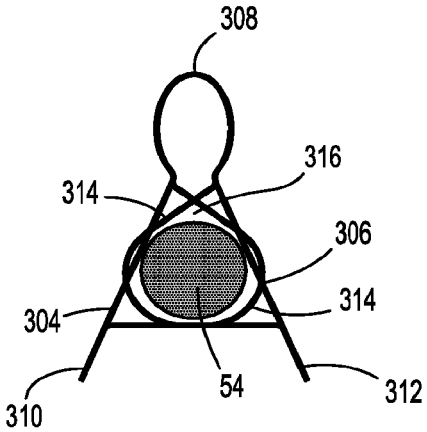
FIG. 25 is a side view of the electrode connector of FIG. 24 illustrating the electrode connector in the initial open condition.
Figure 26:
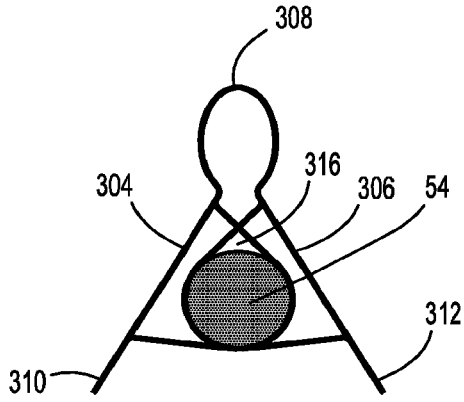
FIG. 26 is a side view of the electrode connector of FIG. 24 illustrating the electrode connector in the closed condition.

FIGS. 24-26 illustrate another alternate embodiment of the present disclosure. Electrode connector 300 includes base 302 or strip member of metallic material bent at an angle ranging from about 110 degrees to about 150 degrees, preferably, about 135 degrees to form first and second legs 304, 306 connected by bend 308 and having respective first and second free ends 310, 312. First leg 304 may have electrode lead wire 20 connected thereto. Each leg 304, 306 includes at least one, preferably, two hemispheric or loop segments 314 extending inwardly from the remaining portions of the respective first and second legs 304, 306. When first and second free ends 310, 312 of first and second legs 304, 306 are moved toward each other as depicted in FIG. 25, hemispheric segments 314 align to define an aperture 316 having a first relatively large internal dimension or diameter, i.e., an expanded condition of the aperture 316. In this expanded condition, electrode connector 300 is positioned about male terminal 54 of biomedical electrode 50 by reception of the male terminal 54 within aperture 316. Upon release of first and second free ends 310, 312, the free ends 310, 312 move radially outwardly under the influence of the resilient characteristics of bend 308 to thereby cause the aperture 316 to assume a second relatively small internal dimension or diameter. In this condition, the internal surfaces defining hemispherical segments 314 engage male terminal 54 of biomedical electrode 50 in secured relation. Hemispherical segments 314 define multiple points of contact with male terminal 54, particularly, when two hemispheric segments 314 are incorporated within each of first and second legs 304, 306, and provide a relatively strong force of engagement on the male terminal 54 when in the closed position. In the open position, the size of aperture 316 defined by hemispherical segments 314 enables the operator to remove or place electrode connector 300 relative to male terminal 54 with minimal force.

Figure 27:
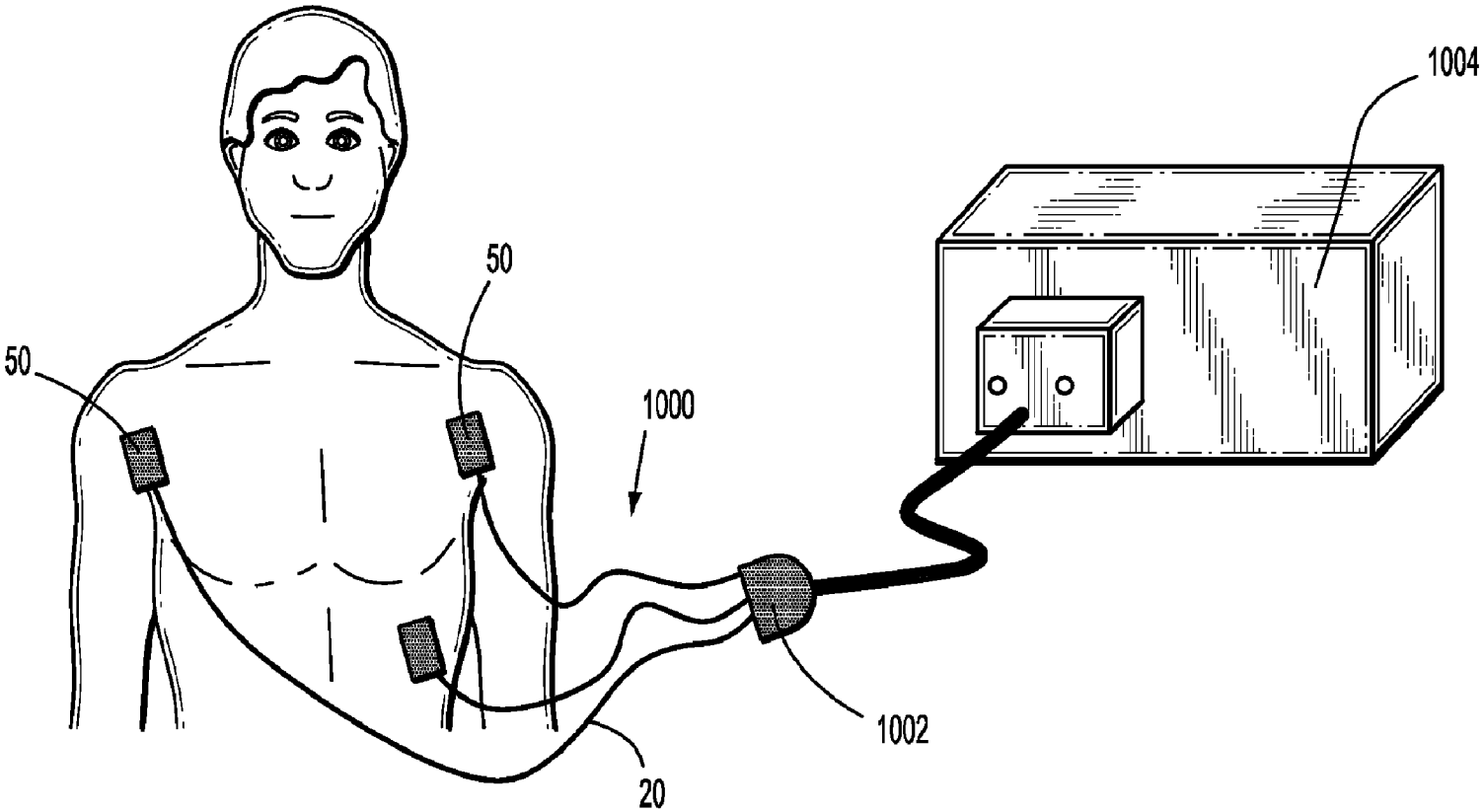
FIG. 27 is a perspective view of a biomedical electrode lead set assembly incorporating any of the electrode connectors of the present disclosure.

FIG. 27 illustrates an electrode lead set assembly 1000 which may incorporate any of the electrode connectors of the embodiments of FIGS. 1-26. Electrode lead set assembly 1000 includes lead wires 20 attached to any embodiment of the electrode connector and leading to a device connector 1002. Device connector 1002 may be any suitable connector adapted for connection to a medical device 1004. One suitable medical device connector may be a modular connector similar to those used for Registered Jacks Including RJ14, RJ25, and RJ45 connectors. Medical device 1004 may be an electrocardiogram apparatus, fetal or maternal monitoring apparatus or a signal generator adapted to transmit electrical impulses or signals for therapeutic reasons to the patient.

Although the illustrative embodiments of the present disclosure have been described herein with reference to the accompanying drawings, it is to be understood that the disclosure is not limited to those precise embodiments, and that various other changes and modifications may be effected therein by one skilled in the art without departing from the scope or spirit of the disclosure.

What is claimed is:

1. A biomedical electrode connector for coupling with a biomedical electrode of the type including an electrode base and a male terminal projecting from the electrode base, the electrode connector comprising:

a connector element including a coiled segment defining a terminal receiving aperture; and a sheath at least partially mounted about the connector element and dimensioned and adapted to rotate relative to the connector element to assume a first relative position with respect to the connector element whereby the terminal receiving aperture of the coiled segment defines a first internal dimension to permit passage of the male terminal therethrough and a second relative position with respect to the connector element whereby the terminal receiving aperture defines a second internal dimension less than the first internal dimension with the coiled segment contacting the male terminal of the electrode in substantial secured relation therewith.

2. A biomedical electrode connector for coupling with a biomedical electrode of the type including an electrode base and a male terminal projecting from the electrode base, the electrode connector comprising:

a connector element including a coiled segment defining a terminal receiving aperture and connector ends depending from the coiled segment; and a sheath at least partially mounted about the connector element and adapted to assume a first relative position with respect to the connector element whereby the terminal receiving aperture of the coiled segment defines a first internal dimension to permit passage of the male terminal therethrough and a second relative position with respect to the connector element whereby the terminal receiving aperture defines a second internal dimension with the coiled segment contacting the male terminal of the electrode in substantial secured relation therewith, the connector ends being engaged and manipulated by the sheath when the sheath is in the first and second relative positions to cause the terminal receiving aperture to correspondingly assume the first and second internal dimensions.

3. The biomedical electrode connector according to claim 2 wherein the coiled segment is normally biased to assume the second internal dimension.

4. The biomedical electrode connector according to claim 3 wherein the sheath includes a first pair of diametrically opposed lobes and a second pair of diametrically opposed lobes, the connector ends of the connector member being at least partially received within the first pair of lobes when the sheath is in the first relative position and being at least partially received within the second pair of lobes when the sheath is in the second relative position.

5. The biomedical electrode connector according to claim 3 wherein the sheath is adapted for rotational movement relative to the connector ends of the connector member to move between the first and second relative positions, the sheath defines a cross-sectional dimension with a minor axis and a major axis, the connector ends being positioned in general alignment with the minor axis when the sheath is in the first relative position and being positioned in alignment with the major axis and in spaced relation when the sheath is in the second relative position.

6. The biomedical electrode connector according to claim 5 corresponding sheath includes internal locking shelves to assist in retaining the connector ends in alignment with the respective major and minor axes.

7. The biomedical electrode connector according to claim 3 wherein the sheath is adapted for longitudinal movement relative to the connector element to cooperatively engage the connector ends and causes the coiled segment to respectively assume the first and second relative positions.

8. The biomedical electrode connector according to claim 7 wherein the sheath includes an internal tapered surface engageable with the connector ends to cause the connector ends to assume an approximated relation upon movement of the sheath to the first relative position and to permit the connector ends to assume a spaced relation upon movement of the sheath to the second relative position.

9. A biomedical electrode assembly, which comprises:

a biomedical electrode including an electrode base and a male terminal projecting from the electrode base; and an electrode connector, including:

a connector element including a coiled segment defining a terminal receiving aperture; and a sheath at least partially mounted about the connector element, the sheath being dimensioned and adapted for at least one of longitudinal movement or rotational movement relative to the connector element between a first relative position with respect to the connector element whereby the terminal receiving aperture of the coiled segment defines a first internal dimension to permit passage of the male terminal therethrough and a second relative position with respect to the connector element whereby the terminal receiving aperture defines a second internal dimension with the coiled segment contacting the male terminal of the electrode in substantial secured relation therewith.

10. The biomedical electrode connector according to claim 1 wherein the sheath includes internal locking shelves to assist in retaining the locking sheath in at least one of the first and second relative positions.

11. The biomedical electrode connector according to claim 2 wherein the second internal dimension of the terminal receiving aperture of the coiled segment is less than the first internal dimension.

12. The biomedical electrode connector according to claim 11 wherein the coiled segment is normally biased to assume the second internal dimension.

13. The biomedical electrode assembly according to claim 9 wherein the second internal dimension of the terminal receiving aperture is less than the first internal dimension of the terminal receiving aperture.

14. The biomedical electrode assembly according to claim 13 wherein the sheath is dimensioned and adapted for rotational movement relative to the connector element to assume the first and second relative positions with respect to the connector element.

15. The biomedical electrode connector according to claim 14 wherein the coiled segment is normally biased to assume the second internal dimension.

16. The biomedical electrode assembly according to claim 13 wherein the sheath is dimensioned and adapted for longitudinal movement relative to the connector element to assume the first and second relative positions with respect to the connector element.

17. The biomedical electrode connector according to claim 16 wherein the coiled segment is normally biased to assume the second internal dimension.

18. A biomedical electrode assembly, which comprises:

a biomedical electrode including an electrode base and a male terminal projecting from the electrode base; and an electrode connector, including:

a connector element including an inner terminal segment defining a terminal receiving aperture; and a movable member at least partially mounted about the connector element, the movable member being dimensioned and adapted for at least one of longitudinal movement or rotational movement relative to the connector element between a first relative position with respect to the connector element whereby the terminal receiving aperture of the inner terminal segment defines a first internal dimension to permit passage of the male terminal therethrough and a second relative position with respect to the connector element whereby the terminal receiving aperture defines a second internal dimension with the terminal segment of the connector element establishing an electrical connection with the male terminal of the electrode.

19. The biomedical electrode assembly according to claim 18 wherein the movable member is dimensioned and adapted for rotational movement relative to the connector element to assume the first and second relative positions with respect to the connector element.

20. The biomedical electrode connector according to claim 19 wherein the inner terminal segment is normally biased to assume the second internal dimension.

21. The biomedical electrode connector according to claim 20 wherein the inner terminal segment of the connector element is generally arcuate.

22. The biomedical electrode connector according to claim 19 wherein the movable member includes a sheath.

23. The biomedical electrode connector according to claim 22 wherein the connector element includes connector ends depending from the inner terminal segment, the connector ends being engaged and manipulated by the sheath when the sheath is in the first and second relative positions to cause the terminal receiving aperture to correspondingly assume the first and second internal dimensions.

24. The biomedical electrode assembly according to claim 18 wherein the sheath is dimensioned and adapted for longitudinal movement relative to the connector element to assume the first and second relative positions with respect to the connector element.

25. The biomedical electrode connector according to claim 24 wherein the inner terminal segment is normally biased to assume the second internal dimension.

26. The biomedical electrode connector according to claim 25 wherein the inner terminal segment of the connector element is generally arcuate.

27. The biomedical electrode connector according to claim 24 wherein the movable member includes a sheath.

28. The biomedical electrode connector according to claim 27 wherein the connector element includes connector ends depending from the inner terminal segment, the connector ends being engaged and manipulated by the sheath when the sheath is in the first and second relative positions to cause the terminal receiving aperture to correspondingly assume the first and second internal dimensions.

* * * * *